US005972837A

United States Patent [19]

Satoh et al.

[11] Patent Number: 5,972,837

[45] Date of Patent: Oct. 26, 1999

[54] REVERSIBLE THERMAL-RECORDING COMPOSITE AND REWRITABLE REVERSIBLE THERMAL-RECORDING SHEET AND CARD USING THE SAME

[75] Inventors: Shōko Satoh; Kazuyoshi Yatsushige; Sōichi Hasegawa; Kazuo Nate, all of Kawasaki, Japan

[73] Assignee: Sliontec Corporation, Kanagawa, Japan

[21] Appl. No.: 08/930,502

[22] PCT Filed: Jan. 27, 1997

[86] PCT No.: PCT/JP97/00221

§ 371 Date: Sep. 30, 1997

§ 102(e) Date: Sep. 30, 1997

[87] PCT Pub. No.: WO97/28005

PCT Pub. Date: Jul. 8, 1997

[30] Foreign Application Priority Data

| | | | |
|---|---|---|---|
| Jan. 31, 1996 | [JP] | Japan | 8-015284 |
| Jul. 5, 1996 | [JP] | Japan | 8-176350 |

[51] Int. Cl.[6] ..... B41M 5/28

[52] U.S. Cl. ..... 503/209; 106/31.23; 503/201; 503/207

[58] Field of Search ..... 503/201, 208, 503/209, 207; 427/150–152; 106/31.16, 31.23

[56] References Cited

FOREIGN PATENT DOCUMENTS

| | | | |
|---|---|---|---|
| 58-191190 | 11/1983 | Japan | 503/201 |
| 60-193691 | 10/1985 | Japan | 503/201 |
| 62-255482 | 11/1987 | Japan | 503/201 |
| 63-39377 | 2/1988 | Japan | 503/201 |
| 63-41186 | 2/1988 | Japan | 503/201 |
| 63-135291 | 6/1988 | Japan | 503/201 |
| 2-566 | 1/1990 | Japan | 503/201 |
| 2-1363 | 1/1990 | Japan | 503/201 |
| 2-80289 | 3/1990 | Japan | 503/201 |
| 2-81672 | 3/1990 | Japan | 503/201 |
| 2-86491 | 3/1990 | Japan | 503/201 |
| 3-243952 | 10/1991 | Japan | 503/201 |
| 4-14482 | 1/1992 | Japan | 503/201 |
| 4-46986 | 2/1992 | Japan | 503/201 |
| 4-50289 | 2/1992 | Japan | 503/201 |
| 4-50290 | 2/1992 | Japan | 503/201 |
| 5-92661 | 4/1993 | Japan | 503/201 |
| WO 90/11898A1 | 10/1990 | WIPO | 503/201 |

*Primary Examiner*—Bruce H. Hess

*Attorney, Agent, or Firm*—Birch, Stewart, Kolasch & Birch, LLP

[57] ABSTRACT

A reversible thermal-recording composite capable of exerting great performance for repeated use and yielding good printing quality at higher coloring concentrations is provided, wherein the coloring and fading reaction of a leuco dye with a coloring and fading agent is utilized and a specific coloring and fading agent, a specific inorganic filler and a specific amine compound and the like are used in the thermal-recording layer, and a thermal-recording sheet and a thermal-recording card using the same are also provided.

The thermal-recording sheet comprises the thermal-recording composite and comprises at least (1) a substrate, (2) a reversible thermal-recording layer and (3) a protective layer, wherein the thermal-recording layer contains a reversible coloring dye, a coloring and fading agent, an inorganic filler and an amine compound in an organic polymeric binder and the coloring and fading agent is an amide compound produced by dehydration condensation of an aliphatic carboxylic acid with a phenolic hydroxyl group and an aliphatic alkylamine. A reversible thermal-recording composite with a higher coloring concentration, greater long-term stability of image, excellent printing quality and good durability for repetition, can be realized, together with a thermal-recording sheet or card using the same.

4 Claims, 3 Drawing Sheets

REVERSIBLE THERMAL-RECORDING COMPOSITE AND REWRITABLE REVERSIBLE THERMAL-RECORDING SHEET AND CARD USING THE SAME

BACKGROUND OF THE INVENTION

1. Field of the Invention

The present invention relates to a reversible thermal-recording composite capable of forming and erasing image, and a rewritable reversible thermal-recording sheet and a rewritable thermal-recording card using the same; more specifically, the present invention relates to a rewritable reversible thermal-recording composite, being capable of yielding a high printing concentration even in the case of low electric power load and having excellent durability for repeated printing and long-term stability of image, and a sheet and a card using the same.

2. Description of the Prior Art

Out of concern for increased garbage output in metropolitan areas and for protection of wood resources and the like, the reduction of paper consumption has become increasingly desirable in recent years. Following the rapid expansion of computer industries, the consumption of OA paper is on the rise with no possibility of reduction, so that finding an alternative to paper consumption is a very urgent issue.

In such circumstances, the research and development works of a reversible thermal-recording composite material capable of forming and erasing image in a repeated manner have been carried out actively. Up to now, inventive disclosures have been made in the following publications;

(1) Japanese Patent Laid-open No. Sho 63-39377;
(2) Japanese Patent Laid-open No. Sho 63-41186;
(3) Japanese Patent Laid-open No. Hei 2-566;
(4) Japanese Patent Laid-open No. Hei 2-1363
(5) Japanese Patent Laid-open No. Hei 2-80289;
(6) Japanese Patent Laid-open No. Hei 2-81672;
(7) Japanese Patent Laid-open No. Hei 2-86491;
(8) Japanese Patent Laid-open No. Sho 58-191190;
(9) Japanese Patent Laid-open No. Sho 60-193691;
(10) Japanese Patent Laid-open No. Sho 62-255482;
(11) Japanese Patent Laid-open No. Hei 4-14482;
(12) International Patent Publication W090/11898;
(13) Japanese Patent Laid-open No. Hei 4-46986;
(14) Japanese Patent Laid-open No. Hei 4-50289;
(15) Japanese Patent Laid-open No. Hei 4-50290;
(16) Japanese Patent Laid-open No. Hei 5-92661; and the like.

The contents described in the items (1) to (7) are characterized in that an organic low molecular substance is dispersed in an organic polymeric binder and the crystallization and polycrystallization of the organic low molecular substance is then reversibly promoted in the binder by thermal energy. Generally, the method for forming an image by utilizing the opaque phenomenon through polycrystallization has drawbacks such as insufficient contrast, which cause difficulty in visual observation.

The inventions disclosed in (8) to (10) comprise a coloring agent, a developer, and an organic polymeric binder, wherein printing is done at a thermal process but the erasing of the resulting printing requires water or steam The contents described in (11) relate to spontaneous erasing of printed image, wherein the control of printing and erasing is difficult.

The contents described in (12) to (16) comprise a leuco dye, a coloring and fading agent reacting with the leuco dye for coloring and fading, and an organic polymeric binder. Generally, a higher contrast along with ready visual observation can be yielded with such thermal composite, but the printability and erasability thereof are reduced if printing and erasing are repeated with such composite. From the respect of industrial application, therefore, the improvement of the durability for repeated printing has been desired greatly. According to the method, additionally, complete switching between coloring reaction and fading reaction cannot be attained under simple control of thermal energy, and both the reactions occur simultaneously at a certain ratio. Thus, satisfactory coloring and sufficient fading cannot be attained concurrently. Because the fading action of a basic group acts on a colored part at room temperature, a phenomenon such that the printing concentration of the colored part is decreased over time is never avoidable.

Therefore, the development of a reversible thermal-recording material, which can produce printing at a high contrast by routine printing process wherein the resulting printed characters can be erased simply through heating and the like and which can retain stable images for a long term in daily atmosphere and that has excellent durability for repeated printing has been greatly desired.

SUMMARY OF THE INVENTION

It is an object of the present invention to overcome the problems of the prior art and to provide a reversible thermal-recording composite capable of retaining stable images at a high printing concentration and with good printing quality in daily use over the long term, which composite has great durability for repeated printing, and to provide a sheet and a card using the same.

The present inventors have made intensive investigations as regards a rewritable reversible thermal-recording material and a process using the same and the like. Consequently, the inventors have found that an amide compound represented by the following general formula (1);

$$R_1R_2CHCONHR_3 \quad (1)$$

[wherein

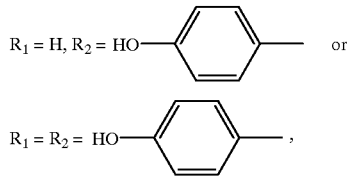

$R_3$ is a linear or branched aliphatic alkyl group represented by $C_n H_{2n+1}$ (n=3 to 22)]

can be used satisfactorily as the coloring and fading agent to be used in a reversible thermal-recording composite, the amide compound being produced by dehydration condensation of an aliphatic carboxylic acid with a phenolic hydroxyl group and an aliphatic alkylamine.

Furthermore, the inventors have found that a specific inorganic filler is satisfactorily added to the reversible thermal-recording composite represented by the general formula (1).

Still furthermore, the inventors have found that a specific inorganic filler and a specific amine compound are satisfactorily added to the reversible thermal-recording composite represented by the general formula (1).

More specifically, a reversible thermal-recording composite capable of repeating coloring and fading contains at least a reversible coloring dye (leuco dye) and a coloring and fading agent in an organic polymeric binder or contains at least a reversible coloring dye (leuco dye), a coloring and fading agent and an inorganic filler in an organic polymeric binder or contains at least a reversible coloring dye (leuco dye), a coloring and fading agent, an inorganic filler and an amine compound in an organic polymeric binder, wherein the leuco dye and the coloring and fading agent are compatible in the polymeric binder under printing conditions whereby the composite can exert the function as a reversible thermal-recording material.

So as to attain the objects of the present invention, a reversible thermal-recording composite capable of repeating coloring and fading, has been prepared comprising a composite containing at least a reversible coloring dye and a coloring and fading agent in an organic polymeric binder, wherein the coloring and fading agent is an amide compound represented by the following general formula (1);

$$R_1R_2CHCONHR_3 \quad (1)$$

[wherein

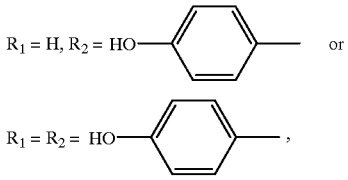

$R_3$ is a linear or branched aliphatic alkyl group represented by $C_nH_{2n+1}$ (n=3 to 22)]

and produced by dehydration condensation of an aliphatic carboxylic acid with a phenolic hydroxyl group and an aliphatic alkylamine.

By using such amide compound produced by dehydration condensation of an aliphatic carboxylic acid with a phenolic hydroxyl group and an aliphatic alkylamine as one of substances having an acidic component and a basic component within the molecule as a coloring and fading agent and subsequently controlling the acidity and basicity by means of heating conditions, coloring and fading can be controlled freely by ring opening reaction (coloring) or ring closing reaction (erasing) of the lactone ring in a leuco dye, for example, as a reversible coloring dye, whereby a reversible thermal-recording composite capable of yielding a high coloring concentration and capable of retaining stable images for a long term can be produced effectively.

The present invention includes a reversible thermal-recording composite capable of repeating coloring and fading, comprising a composite containing at least a reversible coloring dye, a coloring and fading agent and an inorganic filler in an organic polymeric binder, wherein the coloring and fading agent is an amide compound represented by the following general formula (1);

$$RR_2CHCONHR_3 \quad (1)$$

[wherein

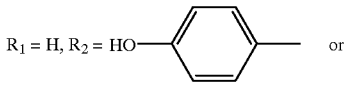

-continued

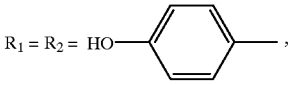

$R_3$ is a linear or branched aliphatic alkyl group represented by $C_nH_{2n+1}$ (n=3 to 22)]

and produced by dehydration condensation of an aliphatic carboxylic acid with a phenolic hydroxyl group and an aliphatic alkylamine.

As has been described above, the addition of an inorganic filler such as kaolin to a reversible thermal-recording composite not only can improve the durability for repeated printing but also can elevate the coloring concentration even in the case of low electric power load and can shorten the time until the printing concentration is saturated. Hence, the resulting composite can effectively yield a generally stable coloring concentration under no influence of printing conditions.

The present invention also includes a reversible thermal-recording composite capable of repeated coloring and fading, comprising a composite containing at least a reversible coloring dye, a coloring and fading agent, an amine compound and an inorganic filler in an organic polymeric binder, wherein the coloring and fading agent is an amide compound represented by the following general formula (1);

$$R_1R_2CHCONHR_3 \quad (1)$$

[wherein

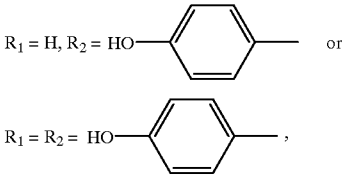

$R_3$ is a linear or branched aliphatic alkyl group represented by $C_nH_{2+1}$ (n=3 to 22)]

and produced by dehydration condensation of an aliphatic carboxylic acid with a phenolic hydroxyl group and an aliphatic alkylamine.

As has been described above, further addition of an amine compound to a reversible thermal-recording composite suppresses the coloring of a thermal-recording layer to produce a thermal-recording layer of excellent quality of appearance. More specifically, if a filler is added to the thermal-recording layer, a reversible coloring dye, for example leuco dye, develops color to color the thermal-recording layer ink, and consequently, therefore, even the resulting thermal-recording layer is colored, whereby the printing quality may sometimes be deteriorated. However, the addition of an amine compound to the reversible thermal-recording composite suppresses the coloring of the thermal-recording layer, thereby suppressing the deterioration of the printing quality.

Additionally, the present invention is a reversible thermal-recording sheet capable of repeating coloring and fading, comprising at least (1) a substrate, (2) a reversible thermal-recording layer and (3) a protective layer, wherein the reversible thermal-recording layer comprises a a reversible thermal-recording composite. The reversible thermal-recording sheet of such composition can have a good optical density, and is excellent in terms of durability for repeated printing and long-term stability of image.

Furthermore, the present invention is a reversible thermal-recording card capable of repeating coloring and fading, comprising at least (1) a substrate, (2) a reversible thermal-recording layer and (3) a protective layer, wherein the reversible thermal-recording layer comprises a a reversible thermal-recording composite. The reversible thermal-recording card of such composition can have a good optical density, and is excellent in terms of durability for repeated printing and long-term stability of image.

Additionally, the present invention is a reversible thermal-recording card capable of repeating coloring and fading, comprising at least (1) a substrate, (2) a reversible thermal-recording layer, (4) an intermediate layer and (3) a protective layer, wherein the reversible thermal-recording layer comprises a reversible thermal-recording composite. By arranging further an intermediate layer comprising for example a polyester resin or the like in the reversible thermal-recording card, a reversible thermal-recording card with more excellent durability for repeated printing and long-term stability of image can effectively be produced.

The principle of coloring and fading by means of the reversible thermal-recording composite of the present invention will now be described below.

When a leuco dye is heated together with an acidic substance called as a coloring agent, both of them or only the coloring agent is melted for reaction, so that the lactone ring is opened in the leuco dye under the influence of the acidity of the coloring agent. Therefore, the leuco dye which is not colored at the ring closing state develops color. Adversely when the leuco dye developing color is put in contact to a basic substance, the ring opened ester group triggers its ring closing reaction, so that the leuco dye resumes its non-colored state. Because these states (ring opening-ring closing reactions) are in equilibrium a compound comprising a substance with an acid component and a basic component within the molecule, for example a compound comprising an organic carboxylic acid with a phenolic hydroxyl group and an organic amine, is used as a coloring and fading agent, to open or close the ring of the lactone ring.

The reason is as follows; because the coloring and fading agent to react with the leuco dye to develop color or fade the color is a substance containing both phenol as an acidic substance and amine as a basic substance, the coloring and fading agent has both the properties as an acid and a base and the acidity and basicity can be controlled at its heated state. More specifically, for instantaneous (pulse) heating at a high temperature (several hundreds ° C.) as in the case of thermal printer, the acidity of phenol slowly works to develop color, while through slow heating around about one hundred ° C., the basic component of amine works to fade the color. The process of coloring and fading can be carried out again and again in a repeated manner.

After various investigations of a reversible thermal-recording material capable of elevating coloring concentration and retaining stable images for a long term on the basis of the coloring and fading principle, the inventors have found that a coloring and fading agent comprising an amide compound produced by dehydration condensation of an aliphatic carboxylic acid containing a phenolic hydroxyl group and an aliphatic alkylamine, is satisfactorily used therefor.

Furthermore, it has been found that further addition of an inorganic filler to the reversible thermal-recording composite can enhance the durability for repeated coloring and fading.

Particularly, a reversible thermal-recording composite to which is preliminarily added kaolin having been treated with vinyl silane process, as one of inorganic fillers, not only can improve the durability for repeated printing but also can elevate the coloring concentration in the case of low electric power load and can shorten the time until the printing concentration is saturated. Hence, such composite can get generally stable coloring concentrations under no influence of printing conditions. When an inorganic filler is added to a thermal-recording layer, generally, the durability thereof for repeated printing can be enhanced but the printing concentration is decreased or the potency of erasing characters is deteriorated, disadvantageously, so a thermal-recording layer, practically durable, can be produced only with much difficulty. In accordance with the present invention, the durability for repeated printing can be enhanced while the printing concentration and the potency of erasing characters can be improved as well.

By adding an amine compound to the thermal-recording layer, furthermore, the coloring of the thermal-recording layer can be suppressed to produce a thermal-recording layer with great quality of appearance. When a filler is added to the thermal-recording layer, generally, a leuco dye develops color to color the thermal-recording ink and color consequently the resulting thermal-recording layer of itself, with the resultant deterioration of the printing quality. In accordance with the present invention, the quality of appearance can be improved while the printing concentration, the potency of erasing characters and the durability for repeated printing can be maintained through the addition of the filler.

In accordance with the present invention, more specifically, the combination of an amide compound represented by the general formula (1) and produced by dehydration condensation of an aliphatic carboxylic acid having a phenolic hydroxyl group and an aliphatic alkylamine, with an inorganic filler such as surface treated kaolin, can improve the durability for repeated printing along with the improvement of the printing concentration and the potency of erasing characters.

A variety of materials and processes to be used in accordance with the present invention are described below. Herein, specific examples are given by way of illustration only, since various changes and modifications within the spirit and scope of the invention will become apparent to those skilled in the art from this detailed description.

As the organic polymeric binder, use is made of common organic polymer materials dissolvable in organic solvents, including acrylic resin, polyester resin, urethane resin, vinyl acetate resin, styrene resin, norbornene resin, vinyl butyral resin, vinyl chloride resin and the like. These may be used singly or in combination of two or more thereof (including mixtures and copolymers).

The dye material of coloring type includes for example leuco dyes, which can develop a variety of colors, such as black, red, and blue. Such leuco dye material includes, for example, crystal violet lactone;

2-(2-chloroanilino)-6-diethylaminofluorane;
2-anilino-3-methyl-6-dibutylaminofluorane;
2-(2-chloroanilino)-6-dibutylaminofluorane;
1,3-dimethyl-6-diethylaminofluorane;
2-N,N-dibenzylaminodiethylaminofluorane;
3-indolino-3-(p-dimethylaminophenyl)-6-dimethylaminophthalide;
3-diethylamino-7-chlorofluorane;
2-(2-fluorophenylamino)-6-diethylaminofluorane;
2-(2-fluorophenylamino)-6-di-n-butylaminofluorane;
3-diethylamino-7-cylohexylaminofluorane;
3-diethylamino-6-methyl-7-anilinofluorane;
3-diethylamino-6-methyl-7-p-butylanilinofluorane;

3-cyclohexylamino-6-chlorofluorane;
2-anilino-3-methyl-6- N-ethyl-p-toluidino)-fluorane;
3-pyrrolidino-6-methyl-7-anilinofluorane;
3-pyrrolidino-7-cyclohexylaminofluorane;
3-N-methylcyclohexylamino-6-methyl-7-anilinofluorane;
3-N-ethylpentylamino-6-methyl-7-anilinofluorane;
3-cyclohexylmethylamino-6-methyl-7-anilinofluorane;
3-ethylisobutylamino-6-methyl-7-anilinofluorane;
3-propylmethylamino-6-methyl-7-anilinofluorane; and the like.

As the coloring and fading agent exerting a coloring and fading action, use is made of an amide compound produced by dehydration condensation of an aliphatic carboxylic acid containing a phenolic hydroxyl group and an aliphatic amine, as represented by the general formula (1).

As the amine component ($RNH_2$) represented by the general formula (1), use is made of aliphatic amine compounds, including propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, diisopropylamine, dibutylamine, diamylamine, tripropylamine, tributylamine, cyclohexylamine, benzylamine, dibenzylamine, tribenzylamine and the like. From the respect of the performance of thermal recording preferably, an amine component with 6 to 22 carbon atoms is used.

Specific examples of the inorganic filler include inorganic pigments such as kaolin, calcium carbonate, magnesium carbonate, barium sulfate, calcium sulfate, silicic acid, calcium silicate, magnesium silicate, basic magnesium silicate, roseki, selicite, silica, zirconia, plaster, talc, siliceous earth, satin white, titanium oxide, and zinc oxide.

The amine compound to be added includes propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, diisopropylamine, dibutylamine, diamylamine, tripropylamine, tributylamine, cyclohexylamine, benzylamine, dibenzylamine, and tribenzylamine. Additionally, the amine compound includes amines containing an aromatic ring and an unsaturated bond within the group. From the respect of the performance of thermal-recording, preferably, amine compounds with 6 to 22 carbon atoms are used.

Thermoplastic substances to be added as other components include arnauba wax, paraffin wax, polyethylene wax, polypropylene wax, stearylamide, oleylamide, palmitylamide, laurylamide, N-laurylbenzamide, N-stearylbenzamide, N,N-distearylbenzamide, N,N-dilaurylbenzamide, N,N-distearylterephthalylamide, ethylene bisstearylamide, ethylene bispalmitylamide, benzene sulfone amide, toluene sulfone amide, ethyl benzene sulfone amide, octyl benzene sulfone amide, lauryl benzene sulfone amide, and stearyl benzene sulfone amide and the like.

If necessary, furthermore, an additive such as ultraviolet absorbing agent may satisfactorily be added to the reversible thermal-recording composite of the present invention. As the substrate for the sheet, use is made of plain paper and a polyester sheet, and the substrate for the card, is made of a polyester sheet with a magnetic layer. As the protective layer for the sheet and the intermediate layer and protective layer for the card, use is made of common thermoplastic resins, thermosetting resins, ultraviolet setting resins and the like.

The principle of repeating coloring and fading in accordance with the present invention and the principle of enhancing coloring concentration are described below.

When printing is done (through instantaneous heating) on a thermal printer, by means of a thermal-recording composite (coloring and fading agent) comprising a leuco dye and a compound comprising a carboxylic acid with a phenolic hydroxyl group and an aliphatic amine, the acidic carboxylic acid serves for coloring, while through gradual heating, the basic amine serves for fading.

By using the coloring and fading agent of the present invention, in particular, the coloring concentration can be enhanced and the image stability can be maintained for a long term, together with the improvement of the spontaneous fading property. The effects thereof will now be described below.

More specifically, the coloring and fading agent of the present invention contains an amide bond with the hydrogen binding potency within the structure, and therefore, the agent is rapidly crystallized owing to the intermolecular hydrogen bonding. The cooling stage is immediately done after heating. The agent is solidified while the agent is developing color, whereby the ring opened leuco dye (at a state of color developing) is stabilized together with the enhancement of the coloring concentration, to produce a thermal-recording layer with excellent performance. Because the state of developing color can be maintained stably, the spontaneous fading property can be improved.

By adding an inorganic filler into the thermal-recording layer, furthermore, not only the durability of the thermal-recording layer for repeated printing can be improved but also the coloring concentration and character erasing property thereof in the case of low electric power load can be enhanced, compared with no inorganic filler added. This is a totally different phenomenon from the phenomenon that an inorganic filler added to a thermal-recording layer can reduce the printing concentration or deteriorate the character erasing potency, which has been generally believed up to now.

The inorganic filler should be added at preferably about 50% by weight (abbreviated as "wt %" hereinbelow) or more, more preferably about 50 wt % or more to about 200 wt % or less to the solid components in the thermal-recording layer. If the inorganic filler is added below the range, some or all of the effects of the inorganic filler for improving the durability for repeated printing may be insufficient. If the inorganic filler is added above the preferable range, the printing quality may sometimes be deteriorated, An amine compound if added to the thermal-recording layer can improve the quality of appearance by suppressing the coloring of the thermal-recording ink through the addition of an inorganic filler while maintaining still the printing quality. This is also a totally different phenomenon from the phenomenon that free amines if contained in the thermal-recording layer reduce the printing concentration or deteriorate the stability of image, which has been generally believed up to now.

The amine compound should be added at preferably about 20 wt % or less, more preferably about 1 wt % or more to about 10 wt % or less to the coloring and fading agent in the thermal-recording layer. Below the preferable range, some of the effects of the amine compound for improving the quality of appearance may be insufficient. Above the preferable range, the printing quality or the stability of image may be insufficient.

DESCRIPTION OF THE PREFERRED EMBODIMENTS

Figure 1:
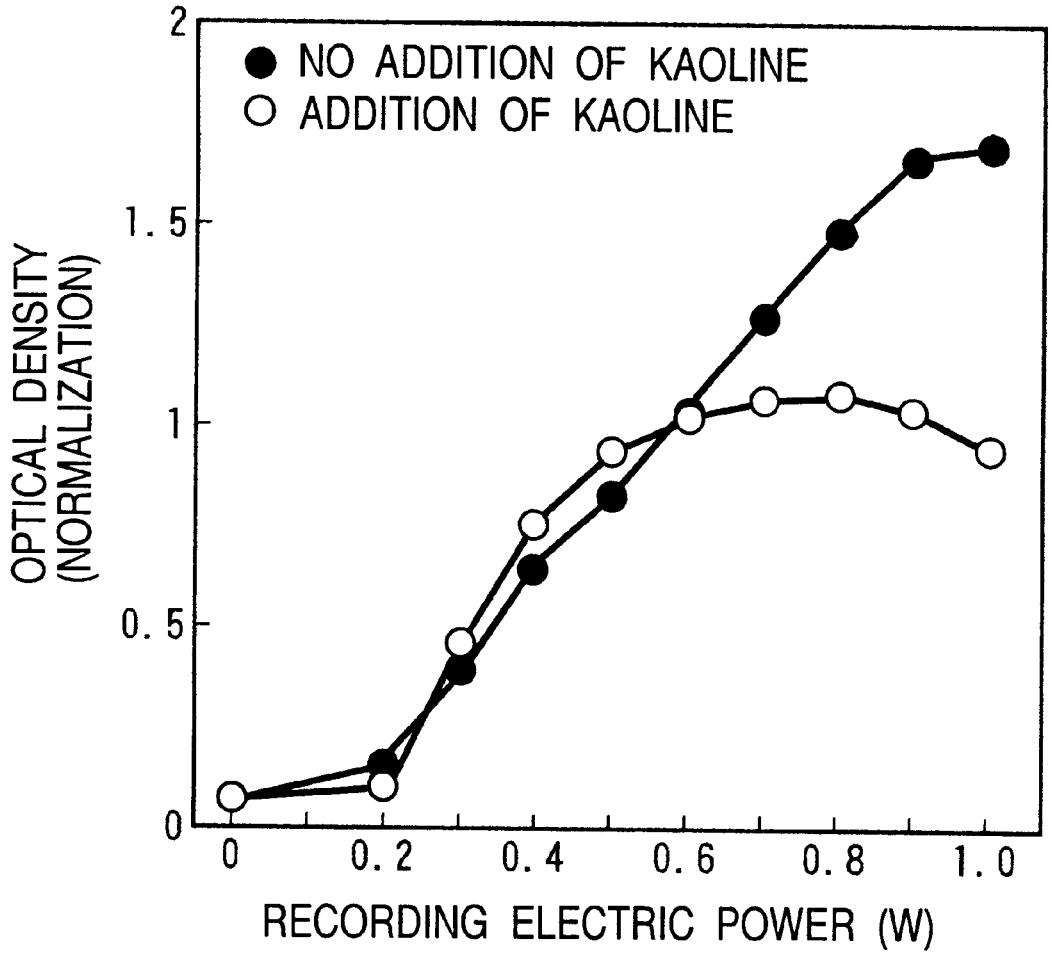
FIG. 1 depicts graphs representing the relation between the printing electric power and the optical density when kaolin is added or not added, as illustrated in the first embodiment of the present Invention.

The present invention will now be described in the following embodiments, but not by way of limitation. The term "part(s)" in the synthetic examples and the embodiments means "part s) by weight".

SYNTHETIC EXAMPLE

Specific synthetic examples of the amide compound represented by the chemical (general) formula 1 are described below.

Synthetic Example 1

Bis(4-hydroxyphenyl)acetic acid-dodecylamide compound (2)

[a compound of the general formula 1, wherein

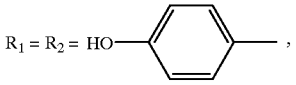

$R_3=C_{12}H_{25}$.]

Firstly, o-phenol (2 mol) and glyoxylic acid (1 mol) were dehydrated and condensed in acidic hydrochloric acid, to recover bis(4-hydroxyphenyl)acetic acid (0.7 mol). Subsequently, the resulting bis(4-hydroxyphenyl)acetic acid (1 mol) and dodecylamine (1 mol) were dissolved in N-methyl-2-pyrrolidone (1 liter), and heated under reflux for 6 hours. After completion of the reaction, purification was carried out to recover bis(4-hydroxyphenyl)acetic acid-stearylamide compound (0.5 mol).

Synthetic Example 2

(4-Hydroxyphenyl)acetic acid-dodecylamide compound (3)

[a compound of the general formula 1, wherein $R_1$=H,

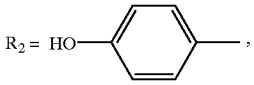

$R_3=C_{12}H_{25}$.]

Firstly, (4-hydroxyphenyl)acetic acid (1 mol) and dodecylamine (1 mol) were dissolved in N-methyl-2-pyrrolidone (1 liter), and heated under reflux for 6 hours. After completion of the reaction, the reaction mixture was cooled to room temperature, followed by addition of distilled water to deposit white crystals, which were then filtered off under reduced pressure. The crystals were recrystallized in acetone, to recover (4-hydroxyphenyl)acetic acid-dodecylamide compound (0.6 mol).

Synthetic Examples 3 to 8

In the same manner as in the Synthetic Examples 1 and 2, the following acid-amide compounds were synthetically yielded.

Synthetic Example 3

Bis(4-hydroxyphenyl)acetic acid-stearylamide compound (4)

[a compound of the general formula 1 wherein

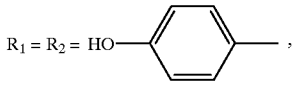

$R_3=C_{18}H_{37}$.]

Synthetic Example 4

Bis(4-hydroxyphenyl)acetic acid-decylamide compound (5)

[a compound of the general formula 1 wherein

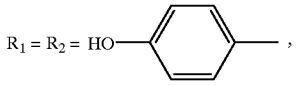

$R_3=C_{10}H_{21}$.]

Synthetic Example 5

Bis(4-hydroxyphenyl)acetic acid-octylamide compound (6)

[a compound of the general formula 1 wherein

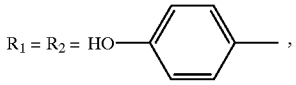

$R_3=C_8H3_{17}$.]

Synthetic Example 6

(4-Hydroxyphenyl)acetic acid-stearylamide compound (7)

[a compound of the general formula 1 wherein $R_1$=H,

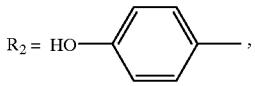

$R_3=C_{18}H_{37}$.]

Synthetic Example 7

(4-Hydroxyphenyl)acetic acid-decylamide compound (8)

[a compound of the general formula 1 wherein $R_1$=H,

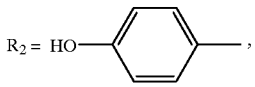

$R_3=C_{10}H_{21}$.]

Synthetic Example 8

(4-Hydroxyphenyl)acetic acid-octylamide compound (9)

[a compound of the general formula 1 wherein $R_1$=H,

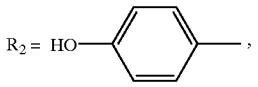

$R_3=C_8H_{17}$.]

First Embodiment

Thermal-recording layer solutions were prepared as follows.

The preparation of thermal-recording layer solution A is firstly described below. Four parts of poly(vinyl acetate) (weight average molecular weight; about 70,000) were dissolved in 31 parts of toluene, and then, 4 parts of 2-anilino-3-methyl-6-dibutylaminofluorane were dispersed in the resulting solution. The resulting dispersion was used as thermal-recording layer solution A.

Then, thermal-recording layer solution B was prepared, by dispersing in 120 parts of toluene, 16 parts of p-hydroxyphenylacetic acid-stearylamide compound, 4 parts of palmitylamide, 28 parts of kaolin (average grain size of about 0.7 μm; manufactured by ENGELHARD, CO. LTD.), and 5 parts of stearylamine.

Figure 3:
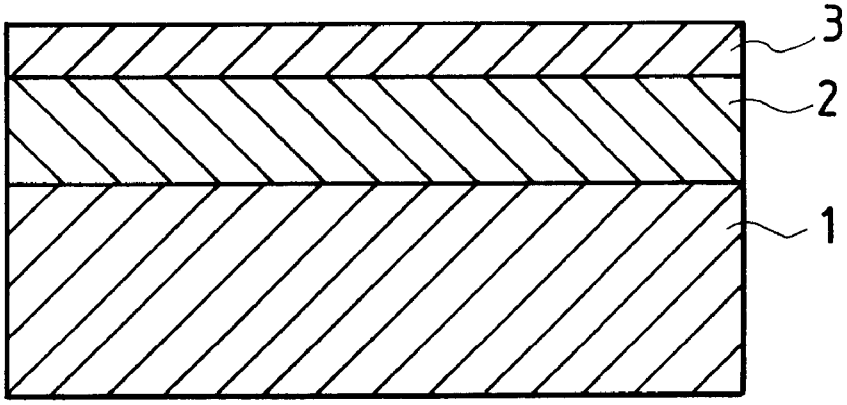
FIG. 3 is a schematic view depicting one example of the cross sectional structure of the reversible thermal-recording sheet, as illustrated in the first embodiment of the present invention.

Subsequently, a thermal-recording sheet of the structure shown in FIG. 3 was prepared by the following procedures.

Firstly, the solutions A and B were individually subjected to a sand mill for 2 hours, and the resulting solutions were mixed together. The resulting mixture was coated on substrate 1 composed of a foaming polyester sheet of about 75 micron thickness by means of a bar coating machine and dried at 60° C. for 10 minutes, to recover reversible thermal-recording layer 2 of about 7 micron thickness. On the layer was coated a solution of polynorbornene (weight average molecular weight; about 100,000) in toluene, to prepare the protective layer 3 of about 1 micron thickness.

Using the thermal-recording sheet thus recovered, printing and character erasing were repeatedly done. Consequently, the sheet had an optical density of 0.8 or more and could be used repeatedly as much as 50 times or more. Also, such composite could be yielded.

Figure 2:
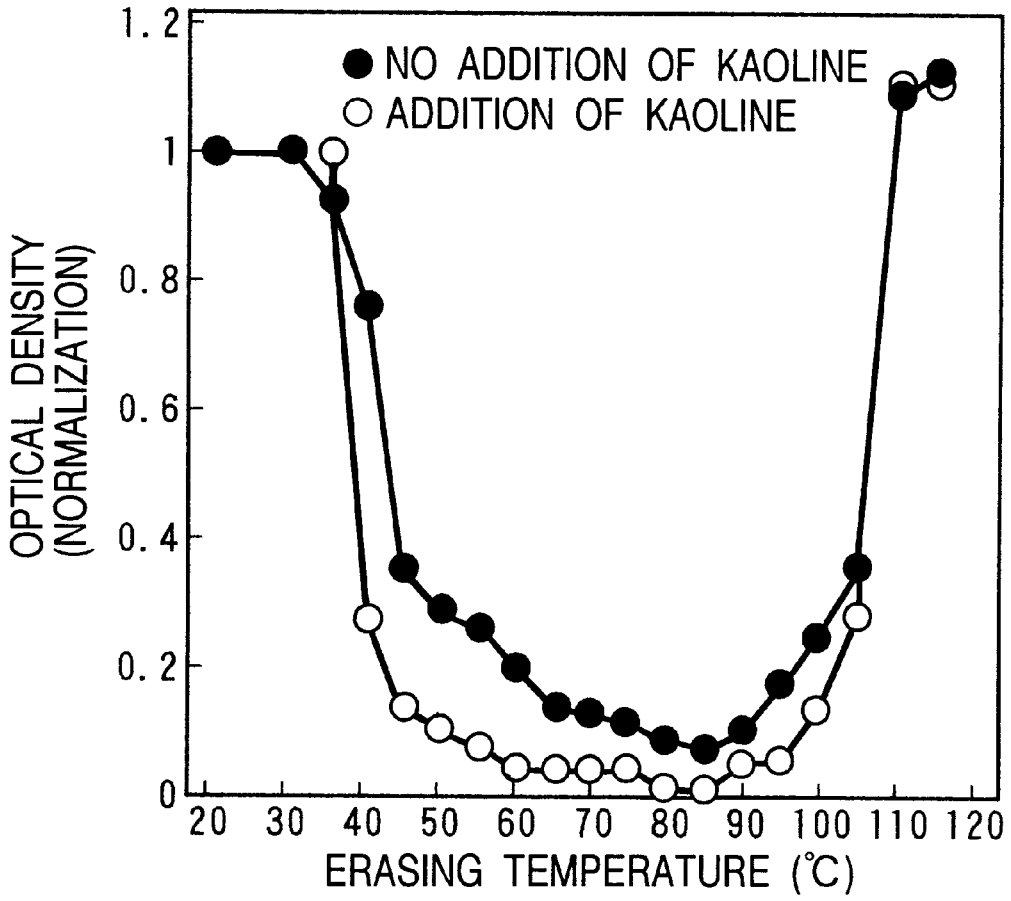
FIG. 2 depicts graphs representing the relation between the erasing temperature and the optical density when kaolin is added or not added, as illustrated in the first embodiment of the present invention.

The performance thereof was examined when kaolin as a filler was added or not added, for comparison. FIG. 1 depicts the relation between the printing electric power (W) and the optical density; and FIG. 2 depicts the relation between the erasing temperature (°C.) and the optical density (normalized). As apparently shown in these figures, the addition of kaolin could improve both the printing concentration and the character erasing potency in the case of low electric power load.

Second Embodiment

In the same manner as in the first embodiment, the following thermal-recording layer solutions A and B were prepared.

Thermal-recording Layer Solution A;

2-(2-chloroanilino)-6-diethylaminofluorane, 4 parts polynorbornene (weight average molecular weight; about 50,000), 8 parts ethyl acetate, 30 parts.

Thermal-recording layer solution B;

p-hydroxyphenylacetic acid-stearylamide compound, 23 parts benzene sulfone amide, 5 parts kaolin, 40 parts ethyl acetate, 120 parts stearylamine, 7 parts.

The solutions A and B were mixed together to prepare a thermal-recording layer solution, which was then coated on a heat-resistance paper of about 100 micron thickness to prepare a thermal recording layer of about 7 micron thickness.

On the layer was coated polynorbornene (weight average molecular weight; about 140,000) containing about 3 wt % of methyl stearate, to prepare a protective layer of about 0.5 micron thickness. Using the thermal-recording sheet thus recovered, recording and character erasing were repeatedly done. Consequently, the sheet had an optical density of 0.8 or more and could be used repeatedly as much as 50 times or more. Also, such composite could be yielded.

Third to Eighth Embodiments

In the same manner as in the first and second embodiments, the reversible thermal-recording inks and protective layer inks were prepared as shown below, which were then coated on a foaming polyester sheet of about 75 micron thickness (third to sixth embodiments) or a polyester sheet with a magnetic layer of about 188 micron thickness (seventh to eighth embodiments), to prepare the sheets of about 5 microns and about 1 micron, respectively. Using the thermal-recording sheets thus recovered, recording and character erasing were repeatedly done. Consequently, the resulting reversible thermal-recording sheets had an optical density of 0.6 or more and could be used repeatedly as much as 50 times or more. Also, such card and composite could be yielded.

Figure 4:
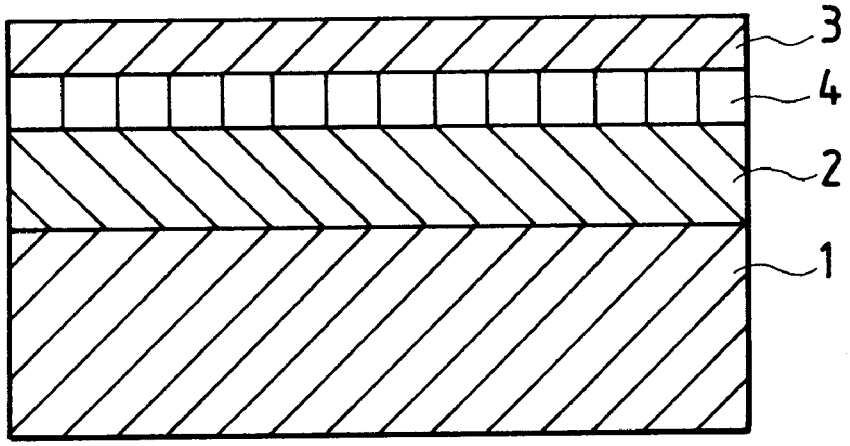
FIG. 4 is a schematic view depicting one example of the cross sectional structure of the reversible thermal-recording card, as illustrated in the third to eighth embodiments of the present invention.

The reversible thermal-recording card can be prepared as a reversible thermal-recording card with far more excellent durability for repeated printing and long-term stability of image, for example, by forming reversible thermal-recording layer 2 on substrate 1 and subsequently forming intermediate layer 4 and arranging protective layer 3 thereon, as shown in FIG. 4.

Third Embodiment

Reversible Thermal-recording Ink;

leuco dye TH-105, manufactured by Hodogaya Chemical , Co. Ltd.), 2 parts p-hydroxyphenylacetic acid-dodecylamide compound, 12 parts acrylic resin (Dianal BR-80, manufactured by Mitsubishi Rayon, Co. Ltd.), 2 parts ultraviolet absorbing agent (SEESORB 701, manufactured by Cypro Chemical, Co. Ltd.), 0.5 part stearylamide, 2 parts kaolin, 10 parts stearylamine, 4 parts toluene, 81.5 parts.

Protective layer;

polynorbornene (ARTON, manufactured by Nippon Synthetic Rubber, Co. Ltd.), 10 parts methyl stearate (Pastel M-180, manufactured by Lion, Co. Ltd.), 0.1 part toluene, 79.9 parts.

Fourth Embodiment

Reversible Thermal-recording Ink;

leuco dye (TH-105, manufactured by Hodogaya Chemical , Co. Ltd.), 2 parts p-hydroxyphenyl acetic acid-decylamide compound, 12 parts acrylic resin (Dianal BR-80, manufactured by Mitsubishi Rayon, Co. Ltd.), 2 parts
ultraviolet absorbing agent (SEESORB 701, manufactured by Cypro Chemical, Co. Ltd.), 0.5 part
stearylamide, 2 parts
kaolin, 18 parts
dodecylamine, 4 parts
toluene, 81.5 parts.
Protective layer;
polynorbornene (ARTON, manufactured by Nippon Synthetic Rubber, Co. Ltd.), 10 parts
methyl stearate (Pastel M-180, manufactured by Lion, Co. Ltd.), 0.1 part
toluene, 89.9 parts.

Fifth Embodiment

Reversible Thermal-recording Ink;
leuco dye (TH-105, manufactured by Hodogaya Chemical , Co. Ltd.), 2 parts
p-hydroxyphenylacetic acid-decylamide compound, 12 parts
polyvinyl acetate (weight average molecular weight of 70,000), 2 parts
ultraviolet absorbing agent (SEESORB 701, manufactured by Cypro Chemical, Co. Ltd.), 0.5 part
stearylamide, 2 parts
kaolin, 15 parts
stearylamine, 4 parts
toluene, 81.5 parts.
Protective layer;
polynorbornene (ARTON, manufactured by Nippon Synthetic Rubber, Co. Ltd.), 10 parts
methyl stearate (Pastel M-180, manufactured by Lion, Co. Ltd.), 0.1 part
toluene, 89.9 parts.

Sixth Embodiment

Reversible Thermal-recording Ink;
leuco dye (TH-105, manufactured by Hodogaya Chemical , Co. Ltd.), 2 parts
p-hydroxyphenylacetic acid-dodecylamide compound, 12 parts
polyvinyl acetate (weight average molecular weight of 70,000), 2 parts
ultraviolet absorbing agent (SEESORB 701, manufactured by Cypro Chemical, Co. Ltd.), 0.5 part
stearylamide, 2 parts
kaolin, 15 parts
dodecylamine, 4 parts
toluene, 81.5 parts.
Protective Layer;
polynorbornene (ARTON, manufactured by Nippon Synthetic Rubber, Co. Ltd.), 10 parts
methyl stearate (Pastel M-180, manufactured by Lion, Co. Ltd.), 0.1 part
toluene, 89.9 parts.

Seventh Embodiment

Reversible Thermal-recording Ink;
leuco dye (TH-105, manufactured by Hodogaya Chemical , Co. Ltd.), 2 parts
p-hydroxyphenylacetic acid-octylamide compound, 12 parts
polyvinyl acetate (weight average molecular weight of 70, 000), 2 parts
ultraviolet absorbing agent (SEESORB 701, manufactured by Cypro Chemical, Co. Ltd.), 0.5 part
stearylamide, 2 parts
kaolin, 10 parts
stearylamine, 6 parts
toluene, 81.5 parts.
Protective Layer;
urethane acrylate ultraviolet setting resin.

Eighth Embodiment

Reversible Thermal-recording Ink;
leuco dye (TH-108, manufactured by Hodogaya Chemical , Co. Ltd.), 2 parts
p-hydroxyphenylacetic acid-octylamide compound, 12 parts
polyvinyl acetate (weight average molecular weight of 70,000), 2 parts
ultraviolet absorbing agent (SEESORB 701, manufactured by Cypro Chemical, Co. Ltd.), 0.5 part
stearylamide, 2 parts
kaolin, 10 parts
dodecylamine, 4 parts
toluene, 81.5 parts.
Intermediate Layer;
polyester resin (0.2 micron thickness)
Protective Layer;
epoxyacrylate ultraviolet setting resin.

Comparative Example 1

A thermal-recording layer solution composed of the thermal recording layer solutions A and B was used to coat a foaming polyester sheet of about 75 micron thickness, which was then dried at 60° C. for 10 minutes to recover a thermal recording layer of about 7 micron thickness. A protective layer composed of polynorbornene was coated at about 1 micron thickness thereon, to prepare a reversible thermal-recording layer.

Thermal-recording Layer Solution A;
2-anilino-3-methyl-6-dibutylaminofluorane, 4 parts
polyvinyl alcohol (weight average molecular weight of about 50, 000), 4 parts
water, 30 parts.
Thermal-recording Layer Solution B;
complex of gallic acid and stearylamine, 16 parts
palmitylamide, 4 parts
water, 120 parts.

The reversible thermal-recording sheet thus recovered had a low optical density, particularly in the case of low printing electric power load, and the printing contrast thereof was deteriorated after several to several tens of repeated use. Therefore, the sheet could not be used in practical sense.

As has been described in detail insofar, the reversible thermal-recording composite of the present invention was used to prepare a reversible thermal-recording sheet capable of forming stable images and characters and erasing them in repetition. Hence, the reversible thermal-recording sheet can replace the OA paper for current use in computer industries and the like, whereby paper consumption can be reduced together with the reduction of paper garbage. Hence, wood resources can be saved. By preparing the composite as a reversible thermal-recording card, the card can print image and character information and erase them in repetition, and therefore, such card can be used as a recording medium of a variety of information.

What is claimed is:

1. A reversible thermal-recording composite capable of repeating coloring and fading, comprising at least a reversible coloring dye, a coloring and fading agent, an amine compound and an inorganic filler in an organic polymeric binder, wherein the coloring and fading agent is an amide compound represented by the following general formula (1);

$R_1R_2CHCONHR_3$ (1)

wherein $R_1$=H, $R_2$=

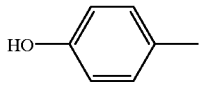

or $R_1$=$R_2$=

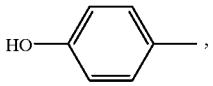

$R_3$ is a linear or branched aliphatic alkyl group represented by $C_nH_{2n+1}$ (n=3 to 22), and is produced by dehydration condensation of an aliphatic carboxylic acid with a phenolic hydroxyl group and an aliphatic alkylamine;

wherein the amount of the amine compound added is within a range of 1–20 parts to 100 parts of the coloring and fading agent; and the inorganic filler is preliminarily surface treated with vinyl silane and the amount thereof added is within a range of 50 parts to 200 parts to 100 parts of the solids in the thermal-recording layer except the filler.

2. A reversible thermal-recording sheet capable of repeating coloring and fading, comprising at least (1) a substrate, (2) a reversible thermal-recording layer and (3) a protective layer, wherein the reversible thermal-recording layer comprises a reversible thermal-recording composite according to claim 1.

3. A reversible thermal-recording card capable of repeating coloring and fading, comprising at least (1) a substrate, (2) a reversible thermal-recording layer and (3) a protective layer, wherein the reversible thermal-recording layer comprises a reversible thermal-recording composite according to claim 1.

4. A reversible thermal-recording card capable of repeating coloring and fading, comprising at least (1) a substrate, (2) a reversible thermal-recording layer, (4) an intermediate layer and (3) a protective layer, wherein the reversible thermal-recording layer comprises a reversible thermal-recording composite according to claim 1.

* * * * *